United States Patent [19]

Dowler et al.

[11] 4,349,995

[45] Sep. 21, 1982

[54] INTERLOCKING PANEL AND PANEL TRACK SYSTEM

[75] Inventors: Danny E. Dowler, 512 Hawthorne St.; Herman F. Oldaker, 2701 18th Ave., both of Parkersburg, W. Va. 26101

[73] Assignees: Danny E. Dowler; Herman F. Oldaker, both of Parkersburg, W. Va.

[21] Appl. No.: 118,094

[22] Filed: Feb. 4, 1980

[51] Int. Cl.[3] ..... E04B 2/74; E04C 2/46

[52] U.S. Cl. ..... 52/241; 52/221; 52/581; 52/582; 52/741; 52/743

[58] Field of Search ..... 52/580, 239, 238, 241, 52/581, 582, 741, 743

[56] References Cited

U.S. PATENT DOCUMENTS

| | | | |
|---|---|---|---|
| 1,445,738 | 2/1923 | Adams | 52/238 |
| 1,585,137 | 5/1926 | Weber | 52/582 |
| 2,079,635 | 5/1937 | Sharp . | |
| 2,105,588 | 1/1938 | Davis . | |
| 2,114,388 | 4/1938 | Killion . | |
| 2,795,305 | 6/1957 | Bagge . | |
| 3,039,569 | 6/1962 | Bohnsack . | |
| 3,282,003 | 11/1966 | Swift, Jr. | 52/580 X |
| 3,720,026 | 3/1973 | Gasteiger | 52/241 |
| 3,774,362 | 11/1973 | Matuschek et al. | 52/286 X |
| 3,830,027 | 8/1974 | Paisley et al. | 52/204 |
| 3,849,962 | 11/1974 | Albinson et al. | 52/300 X |
| 4,035,972 | 7/1977 | Timmons | 52/241 |

FOREIGN PATENT DOCUMENTS

| | | |
|---|---|---|
| 165524 | 10/1955 | Australia . |
| 665903 | 7/1963 | Canada . |
| 670417 | 9/1963 | Canada . |
| 2448983 | 4/1976 | Fed. Rep. of Germany . |
| 1409107 | 7/1965 | France . |
| 1523484 | 3/1968 | France . |
| 425144 | 9/1947 | Italy . |
| 1334820 | 10/1973 | United Kingdom . |

*Primary Examiner*—Alfred C. Perham

*Attorney, Agent, or Firm*—Oblon, Fisher, Spivak, McClelland & Maier

[57] ABSTRACT

An interlocking panel and panel track system which includes at least one frame having a plurality of upright members with first and second end portions, a first and second connector plate member engaging the upright members at the first and second end portions, respectively, the first and second connector plate members each including a flange portion and a notched portion and a plurality of projecting members connected to the upright members and cooperatively engaged with at least one of the first and second connector plate members. A method of assembling the wall panel includes cooperatively connecting at least one of the first and second connector plate members to one end portion of the upright members so as to engage the plurality of projecting members and cooperatively engage the flange portion of the first frame with the notched portion of the second frame and with at least one of the plurality of projecting members so as to interconnect the first and second frame.

12 Claims, 20 Drawing Figures

INTERLOCKING PANEL AND PANEL TRACK SYSTEM

BACKGROUND OF THE INVENTION

1. Field of the Invention

This invention relates to interlocking panels and a panel track system allowing for sturdy, reliable construction of wall panels of a home, office, etc. in a highly economical fashion. The invention also relates to wall construction and to a method of forming a wall with such interlocking panels.

2. Description of the Prior Art

Heretofore, the making of partition walls has either constituted the erection of relatively weak panels that are obviously of relatively fragile structure or an operation that is virtually as costly, slow and disadvantageous as a permanent wall. The former procedure substantially constitutes the positioning of a screen in a room and provides relatively no greater privacy or protection while the latter procedure involves all of the elements of a permanent wall formed at the construction site. Therefore, the corresponding expense is extremely high due the necessity of employing skilled carpenters and plasterers. Accordingly, in order to form wall panels in a rapid and economical manner, it is desirable to preform the wall panels by mass production in a factory such that the same can be transported to the construction site and be rapidly interlocked in a convenient and economical manner. By avoiding construction of wall panels at the construction site, relatively unskilled workmen are able to quickly and efficiently erect the wall panels with the result that the wall panels can be readily and quickly installed or removed with relatively little difficulty and expense.

SUMMARY OF THE INVENTION

One object of the invention is the provision for strong and economically constructed wall panels adapted to be quickly and economically prepared by mass production in a factory and quickly installed at the construction site.

Another object of the invention is the provision for interlocking panels and a panel track system which allows for relatively unskilled workmen to quickly and efficiently construct the interlocking panels for transport to the construction site such that the interlocking wall panels can be readily and quickly installed or removed with relatively little difficulty and expense.

Accordingly, the present invention utilizes a wall panel assembly including at least one frame which includes a plurality of upright members having first and second end portions, a first and second connector plate member engaging the upright members at the first and second end portions, respectively, the first and second connector plate members each including a flange portion and a notched portion, and a plurality of projecting members connected to the upright members and cooperatively engaged with at least one of the first and second connector plate members. Furthermore, the present invention utilizes a method of assembling a wall panel including a first and second frame which includes the steps of cooperatively connecting at least one of the first and second connector plate members to one of the first and second end portions of the upright members so as to engage the plurality of projecting members and cooperatively engaging the flange portion of a first frame with the notched portion of a second frame and with at least one of the plurality of projecting members so as to interconnect the first and second frame.

BRIEF DESCRIPTION OF THE DRAWINGS

Various other objects, features and attendant advantages of the present invention will be fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
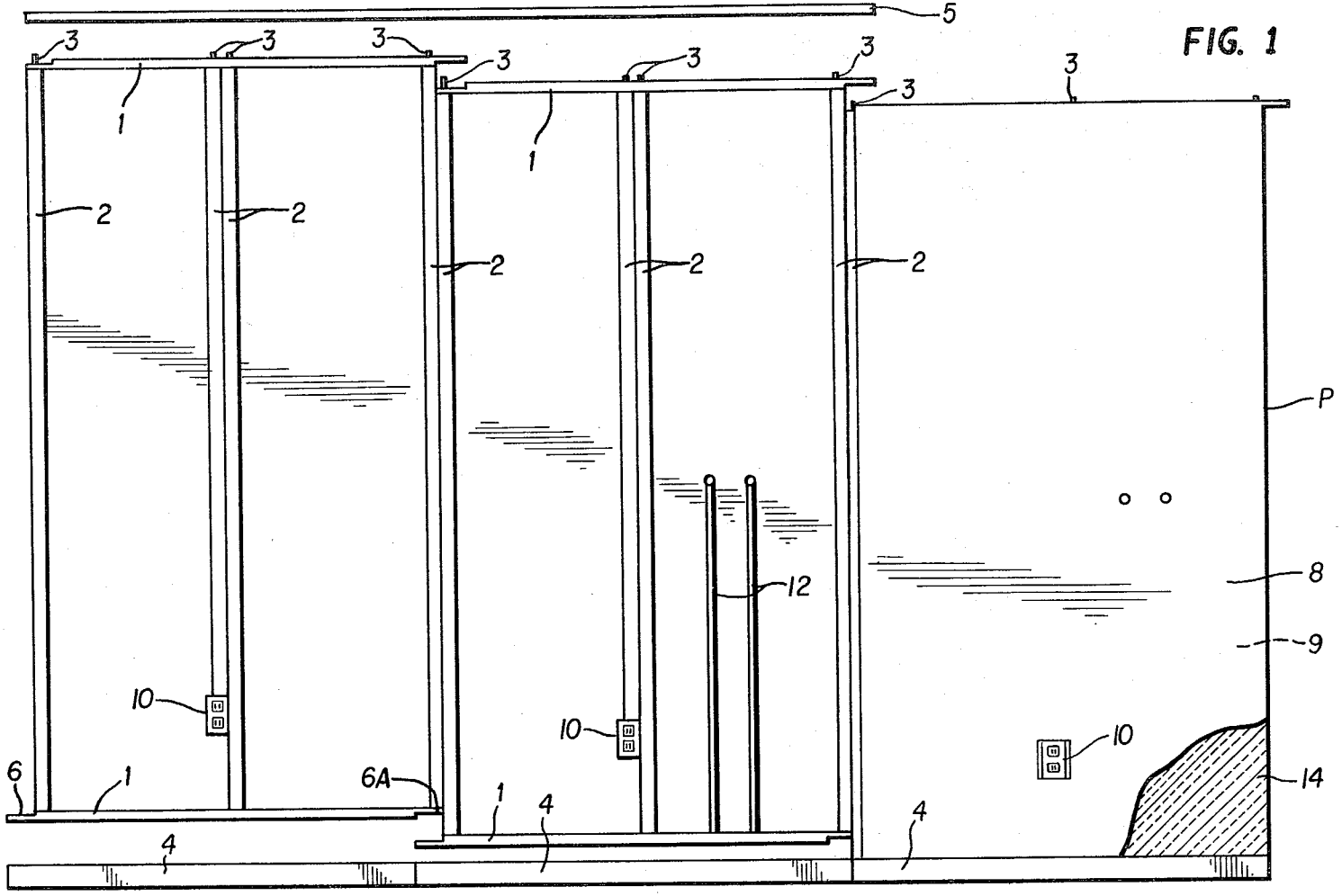
FIG. 1 sets forth an elevational view of the wall assembly and steps involved in the methods of the present invention.

FIG. 1 serves to illustrate the manner in which the interlocking panels of the present invention are formed in the overall panel track system. More particularly, a plurality of connector plates 1 are connected at the top and bottom end portions of a plurality of uprights 2. The connector plate 1 can be connected to the uprights 2 by fasteners or projections 3 which are either secured to the uprights 2 or are integrally formed therefrom.

Upon interconnection of the connector plates 1 with the uprights 2 by the fasteners or projections 3, a standard frame 16 is formed which in turn is inserted into a series of channel-shaped track members 4 which can be, for example, U-shaped or H-shaped. A top connector 5 includes a plurality of holes or apertures formed therein for cooperative engagement with the projections 3 (see FIG. 5).

The connector plates are each provided with a flange 6 being of one half the height of the mid portion of the connector plate 1. The connector plates 1 also include a notched or indented portion 6A for overlapping engagement with the corresponding flange 6 of an adjacent connector 1. The assembled panel P also includes interior panels 8 and exterior panels 9 attached to the uprights or to the connector plates in a conventional manner. Prior to attachment of the interior panel 8 and exterior panel 9, electrical elements 10 and plumbing elements 12 can be positioned within the standard frame 16. It can thus be appreciated that the connector plates, uprights 2, projections 3, interior panel 8, exterior panel 9, electrical elements 10 and plumbing elements 12 can be assembled in the factory and transported to the construction site for insertion into the track members 4 and connection with top connector 5 to form the assembled panel P. Furthermore, insulation can be blown into the panel P in conjunction with the attachment of the interior and exterior panels so as to provide a completely insulated assembled panel P. Alternatively, insulation can be blown in after the exterior and interior panels 8, 9 are attached to the uprights and connector plates.

Figure 2:
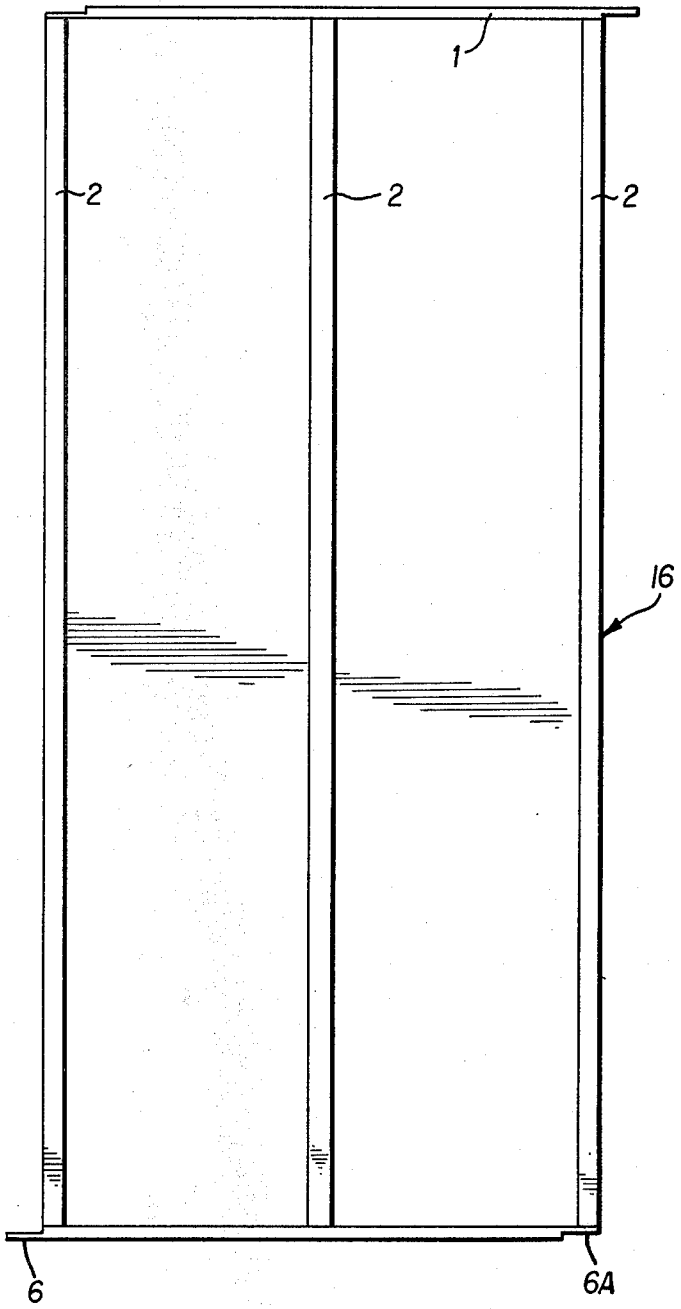
FIG. 2 shows an elevational view of a standard frame constructed in accordance with the present invention.

FIG. 2 illustrates a single standard frame 16 which, for example, may include at least two uprights 2 interconnected at the top and bottom end portions with connector plates 1, each of the connector plates 1 including flange 6 and notched or indented portion 6A. The standard frame 16 shown in FIG. 2 utilizes three uprights so as to provide a sturdier panel while still allowing adequate room for the installation of electrical elements 10 and plumbing elements 12.

Figure 3:
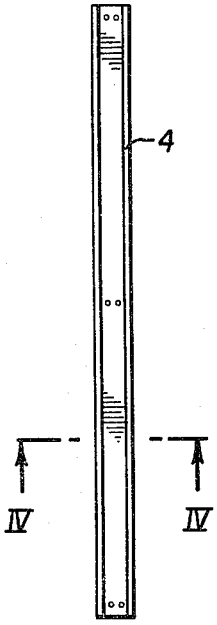
FIG. 3 shows a track member of the present invention.
Figure 4:
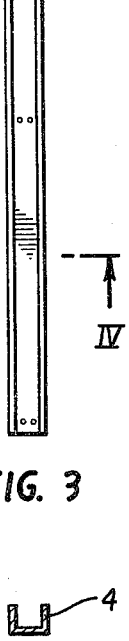
FIG. 4 is a view of FIG. 3 taken along line IV—IV thereof.

FIG. 3 illustrates a typical track member 4 within which the completed standard frame is inserted. It should be noted that the track member 4 can be of such length as to accommodate a plurality of standard frames rather than each individual standard frame 16 as shown in FIG. 1. FIG. 4 is a cross-sectional view of the track member 4 in FIG. 3 and serves to indicate the channel-shaped track member can be of a U-shape. Of course, any other convenient shape can be utilized including a H-shape as long as a channel is formed for the purpose of accommodating the standard frames 16.

Figure 5:
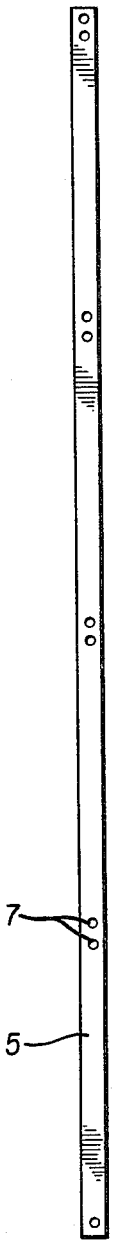
FIG. 5 is a top view of a top connector member of the present invention.

FIG. 5 illustrates the top connector 5 in greater detail and indicates that the top connector 5 can be a bar member of a length which is capable of overlapping a plurality of standard frames. The top connector 5 includes a plurality of holes or apertures 7 as mentioned hereinabove for cooperative engagement with end portions of the projections 3.

Figure 7:
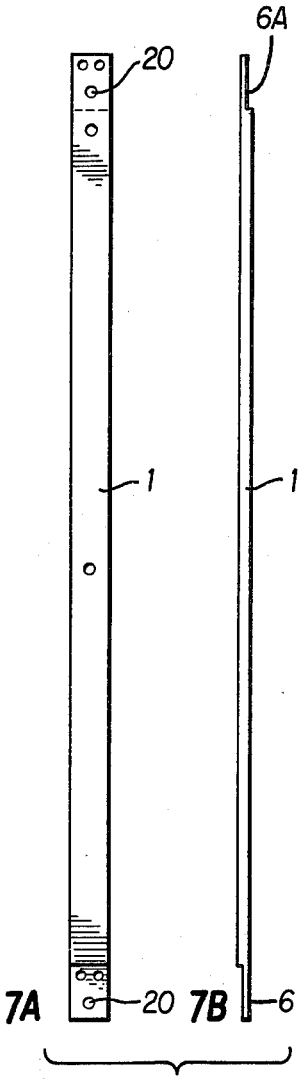
FIGS. 7A and 7B are top and side views of the connector plate of the present invention, respectively.
Figure 6A:
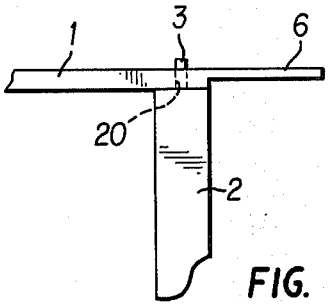
FIGS. 6A to 6D illustrate details of structural members shown in FIG. 1 of the present invention.
Figure 6B:
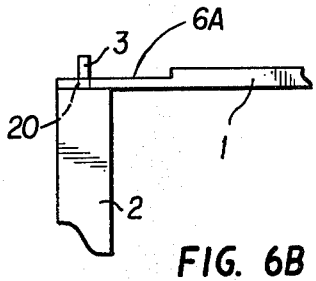
Figure 6C:
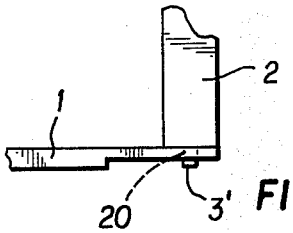
Figure 6D:
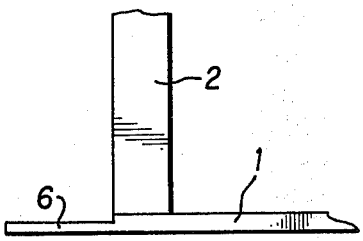

FIGS. 6A through 6D illustrate variations in the interconnection of the connector plates 1, projections 3 and upright members 2. More particularly, FIG. 6A illustrates that the projection 3 can be disposed within holes or apertures 20 formed in connector plates 1 as also shown in FIG. 7A. FIG. 6B also indicates that the holes or apertures 20 can be formed in the notched or indented portions 6A of the connector plate. FIG. 6C illustrates the interconnection of the uprights 2 with the lower connector plates 1 by use of a lower fastener or projection 3' which, as in the case of fastener or projections 3, can either be a separate element attached to the uprights or form an integral part of the uprights themselves. Also, FIG. 6D indicates that the lower end portion of the uprights 2 can be secured directly to the lower connector plates 1 in a conventional manner such as by welding.

FIGS. 7A and 7B illustrate a top view and side view of the connector plates 1. More particularly, the connector plates 1 include a series of holes or apertures 20 formed therein or within the flange 6 or notched or indented portion 6A.

Figure 8:
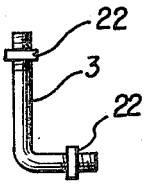
FIG. 8 illustrates the fastener or projection and corresponding securing member used in the present invention.

The fasteners or projections 3 can be of a L-shape as best shown in FIG. 8 thereof and can be interconnected with the connector plates and the uprights by securing members 22. Naturally, one end portion of the fasteners or projections are positioned within a hole or aperture formed in the uprights 2 while the other end portion is disposed within the hole or aperture 20 formed in the connector plate, flange 6 or notched or indented portion 6A and is secured therein by the securing members in a conventional manner.

Figure 9A:
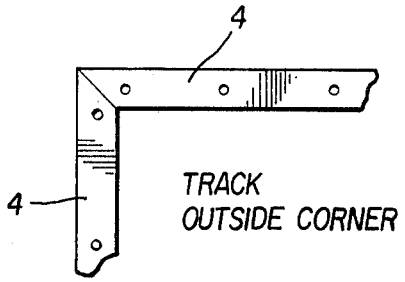
FIGS. 9A to 9F illustrate the manner in which various structural elements are interconnected in accordance with the present invention.
Figure 9D:
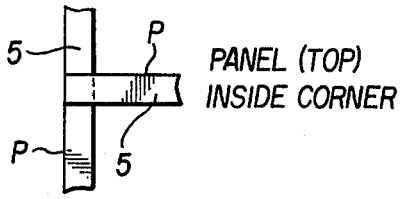
Figure 9B:
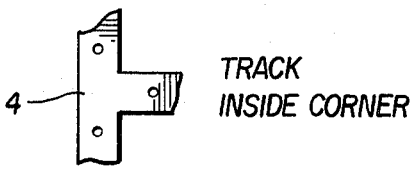
Figure 9E:
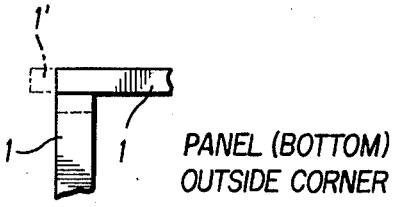
Figure 9C:
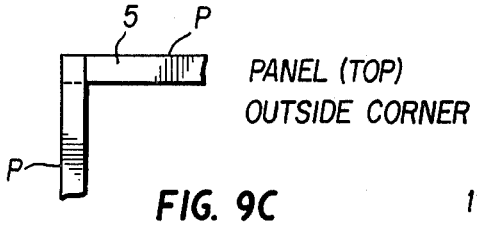
Figure 9F:
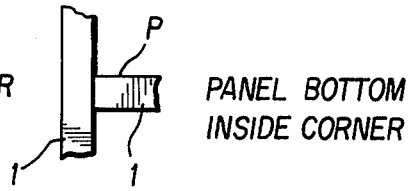

FIG. 9A illustrates the cooperation of end portions of the track member 4 so as to form an outside corner of the interlocking panel while FIG. 9B illustrates the interconnection of the track members along an inside corner. FIG. 9C illustrates the interconnection of the top part of the panels P at the outside corner thereof while FIG. 9D shows the corresponding connection of the panel P at an inside corner. FIG. 9E illustrates the bottom portion of a panel P and its interconnection with another panel P at an outside corner which serves to illustrate that the portion 1' of the connector plate is to be removed at the construction site. FIG. 9F also illustrates the connection of the bottom of the panels P at an inside corner. It is also to be noted that in FIG. 9D, for connection of an inside panel, the same can be cut to make a butt joint or be notched so as to allow for interlocking connection.

Figure 10:
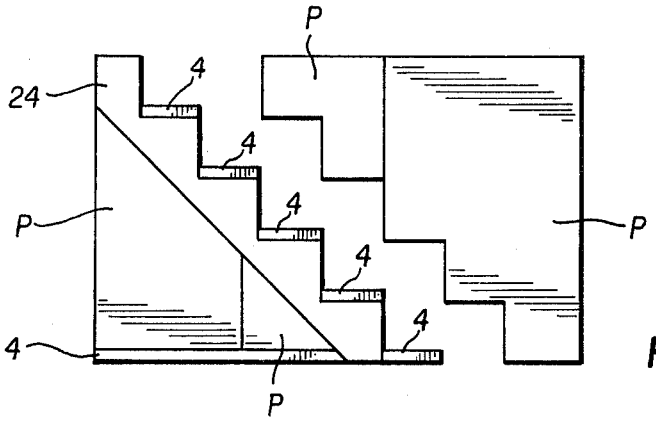
FIG. 10 illustrates the interconnecting of the interlocking panels in conjunction with a stairwall assembly.

FIG. 10 illustrates the manner in which the assembled panels P can be inserted into the corresponding tracks 4 in the field at the location of a stairwall assembly 24. In particular, the series of tracks 4 can be disposed adjacent the level surface of each step of the stairs 24 and beneath the staircase itself. Accordingly, the panels can be formed in the factory in a stepwise fashion and be inserted within the tracks 4 as illustrated in FIG. 10.

Figure 11B:
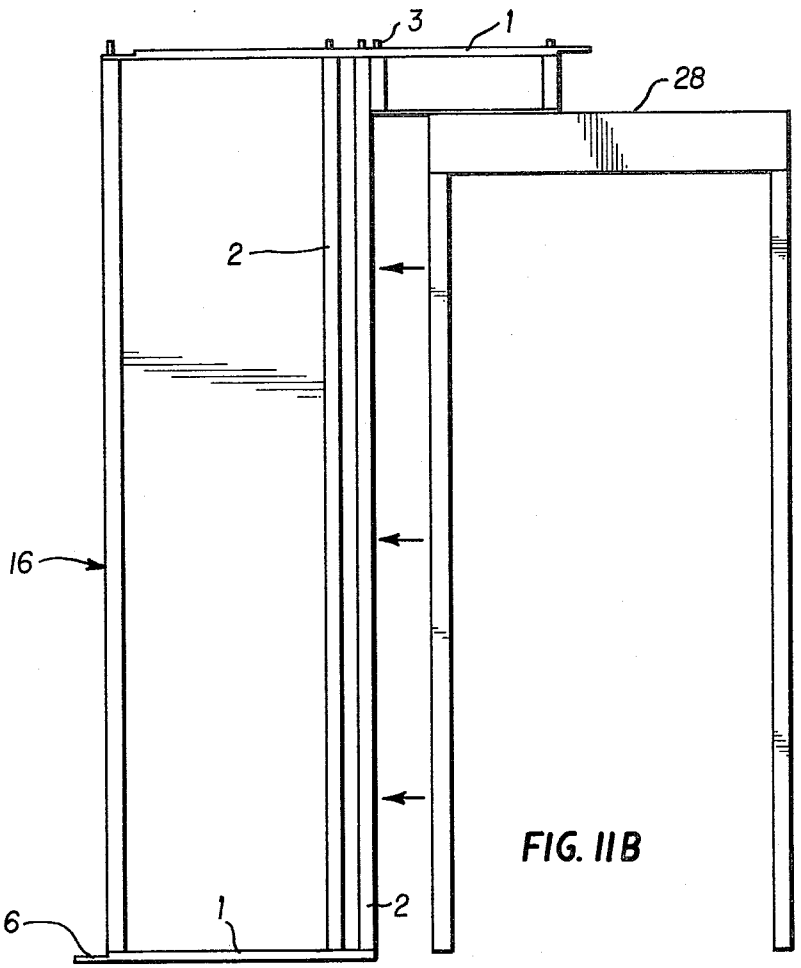
FIGS. 11A and 11B illustrate the manner in which a window frame and door frame, respectively, are installed in the interlocking panel assembly.
Figure 11A:
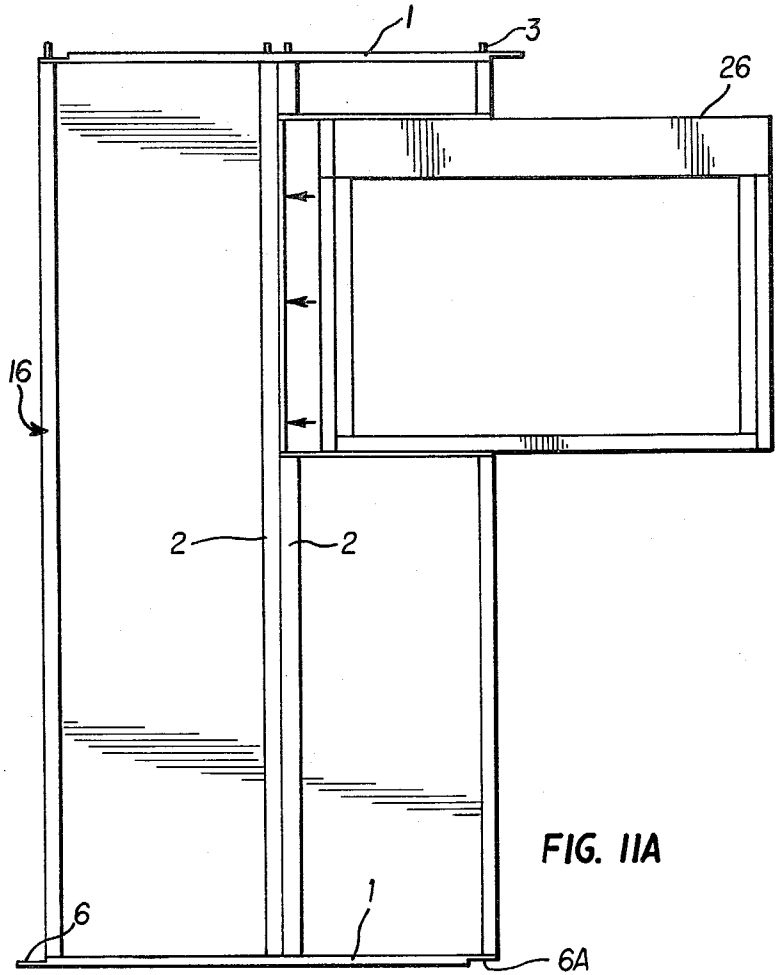

FIGS. 11A and 11B illustrate the manner in which a window frame 26 and door frame 28 can be preassembled for insertion into a preassembled standard frame 16 in the field.

It can thus be appreciated that the method of assembling the interlocking wall panels of the present invention includes the steps of cooperatively connecting at least one of the first and second connector plate members 1 to one of the first and second connecting end portions of the upright members 2 so as to engage the flange portion 6 of the first frame 16 with the notched portion 6A of the second frame 16 and with at least one of the plurality of projecting members 3 so as to interconnect the first and second frames. The standard frame 16 can thus be assembled in the factory and include the steps of installing the electrical elements 10, plumbing elements 12, interior panel 8, exterior panel 9 and injecting insulation 14 into the assembled panel P. The assembled panel P is then transported to the construction site where the track member 4 has already been laid down. The assembled panel P is then inserted into the track member 4 and the top connector 5 is placed at the upper end portion of the assembled panel P for cooperative engagement with the projections 3. The resulting wall panel assembly provides for a strong wall panel assembly which is made in an economical fashion and with relatively little difficulty in construction. Openings can also be formed in the track member 4 where necessary for interconnection of the electrical elements 10 and plumbing elements 12 with other electrical and plumbing elements in the structure to be assembled.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A wall panel assembly comprising:

a plurality of frames in abutting relationship wherein each of said frames comprises:

a plurality of upright members having first and second end portions;

a first and second connector plate member engaging said upright members at said first and second end portions, respectively, said first and second connector plate members each including a flange portion and a notched portion;

a plurality of projecting members integral with said upright members and cooperatively engaged with at least one of said first and second connector plate members;

a top connector flat bar member having a substantially rectangular cross section and having a length capable of overlapping at least two of said plurality of frames and cooperatively engaged with said plurality of projecting members and cooperatively engaged with at least one of said first and second connector plate members wherein said at least one of said first and second connector plate members and said top connector member each include a plurality of apertures formed therein and through which said plurality of projecting members are fitted such that said apertures in said at least one of said first and second connector plate members and said apertures in said top connector member are aligned by said plurality of projecting members; and a track member within which at least one of said first and second connector plate members is disposed.

2. A wall panel assembly as set forth in claim 1, further comprising:

an interior and exterior panel connected to said at least one frame.

3. A wall panel assembly as set forth in claim 1, said plurality of projecting members cooperatively engage with both said first and said second connector plate members.

4. A wall panel assembly as set forth in claim 1, said plurality of projecting members further comprising L-shaped integrally formed bolt members and securing members fitted thereto for interconnecting said at least one of said first and second connector plate members to said upright members.

5. A wall panel assembly as set forth in claim 1, wherein said flange portion of each of said first and second connector plate members extend from opposite side portions of said at least one frame.

6. A wall panel assembly as set forth in claim 1, wherein said notched portions of each of said first and second connector plate members extend from opposite side portions of said at least one frame.

7. A method of assembling a wall panel including a first and second frame each having a plurality of upright members having first and second end portions, a first and second connector plate member having apertures formed therein and each including a flange portion and a notched portion having apertures formed therein and a plurality of projecting members positioned on said upright members and a top connector member having apertures formed therein which comprises:

cooperatively connecting at least one of said first and second connector plate member to one of said first and second end portions of said upright members so as to engage said plurality of projecting members within said apertures formed in said first and second plate member;

cooperatively engaging said flange portion of said first frame with said notched portion of said second frame and with at least one of said plurality of projecting members so as to interconnect said first and second frame; and cooperatively engaging said apertures formed in said top connector member with at least one of said plurality of projecting members in each of said first and second frame so as to interconnect said first and second frame and so as to align said apertures formed in said top connector member with said apertures formed in said first and second connector plate member.

8. The method of assembling a wall panel assembly as set forth in claim 7, said wall panel including a track member having a channel formed therein and which further comprises:

placing at least one of said first and second connector plate members within said channel of said track member so as to interconnect said first and second frame.

9. The method of assembling a wall panel as set forth in claim 8, said wall panel including an interior and exterior panel member and which further comprises:

securing said interior and exterior panel to said first and second frame.

10. The method of assembling a wall panel as set forth in claim 9, said wall panel including electrical elements and which further comprises:

installing said electrical elements in one of said first and second frames prior to securing said interior and exterior panel member.

11. The method of assembling a wall panel assembly as set forth in claim 10, said wall panel including plumbing elements and which further comprises:

installing said plumbing elements in one of said first and second frames prior to securing said interior and exterior panel member.

12. The method of assembling a wall panel as set forth in claims 10 or 11 which further comprises:

installing insulation between said interior and exterior panel member.

* * * * *